US006995325B2

(12) United States Patent
Sakou

(10) Patent No.: US 6,995,325 B2
(45) Date of Patent: Feb. 7, 2006

(54) CONTROLLER OPERATING PORTION STRUCTURE

(75) Inventor: Yoshitaka Sakou, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/929,431

(22) Filed: Aug. 31, 2004

(65) Prior Publication Data

US 2005/0092590 A1 May 5, 2005

(30) Foreign Application Priority Data

Oct. 30, 2003 (JP) ..... P.2003-371284

(51) Int. Cl.
*H01H 9/00* (2006.01)

(52) U.S. Cl. ..... 200/5 R; 200/293; 200/302.2; 200/333

(58) Field of Classification Search ..... 200/5 R, 200/293–295, 302.2, 333, 520, 52 R, 85 R, 200/85 A
See application file for complete search history.

(56) References Cited

U.S. PATENT DOCUMENTS 3,147,661 A 9/1964 Padera
3,704,844 A 12/1972 Wolf
4,105,883 A * 8/1978 Hastings et al. ..... 200/296
4,840,584 A * 6/1989 Cox ..... 439/538
5,335,575 A 8/1994 Hoshino
5,424,502 A * 6/1995 Williams ..... 200/85 A
5,531,148 A 7/1996 Wilson
5,541,377 A * 7/1996 Stuhlmacher ..... 200/296
6,169,256 B1 * 1/2001 Hanahara et al. ..... 200/5 A
6,459,058 B1 * 10/2002 Shinohe et al. ..... 200/341
6,600,118 B2 * 7/2003 Altmann ..... 200/295
6,660,952 B2 * 12/2003 Hsu ..... 200/334

FOREIGN PATENT DOCUMENTS

JP 2002239233 8/2002

OTHER PUBLICATIONS

European Search Report dated Jan. 10, 2005.

* cited by examiner

*Primary Examiner*—Kyung Lee
(74) *Attorney, Agent, or Firm*—Whitham, Curtis & Christofferson, PC

(57) ABSTRACT

Bosses 7*a* and 7*b* are formed on spacers 5*a* and 5*b* provided between a top rubber 4 and a top hoop 3. Guide holes 8*a* and 8*b* for respectively guiding the movements of the bosses 7*a* and 7*b* in accordance with a pounding operation on the top rubber 4 are formed in a flat plate portion 3*a* of the top hoop 3. Bushings 10, made of a high wear-resistant resin, are mounted respectively in the guide holes 8*a* and 8*b*. By doing so, switch-mounting portions 9*a* and 9*b*, switch drive portions 6*a* and 6*b* and so on, provided at the top hoop 3 and the spacers 5*a* and 5*b*, are formed with high positional precision.

6 Claims, 6 Drawing Sheets

CONTROLLER OPERATING PORTION STRUCTURE

BACKGROUND OF THE INVENTION

1. Filed of the Invention

This invention relates to a controller operating portion structure, and more particularly to a controller operating portion structure in which a top hoop and a spacer are produced with high dimensional accuracies, so that switch operating signals can be outputted with positive and good operability.

2. Description of the Related Art

There is known one conventional operating portion of a game controller which resembles a drum and has the following structure. The operating portion of this game controller includes switches, and has a structure for enabling the operation of the switches, and this switch-operating structure comprises a switch receiving portion, a switch position-fixing member, a spacer, and an upper surface sheet member which are arranged in this order from the lower side. Each of the switches is of such a structure that it can be moved between a projected and a retracted position, and when the switch is retracted, it outputs an ON-signal. The switch receiving portion is in the form of a round container, and proximal end portions of the switches and required wiring are received in this switch receiving portion. The switch position-fixing member has a disk-like shape, and has a hole formed therethrough at its center, and also has a plurality of holes formed therethrough and arranged around the center hole in concentric relation thereto. The switches are fixed in these holes, respectively. The spacer is in the form of a disk with a required thickness, and this spacer has holes which are formed therein, and are arranged to correspond respectively to the holes in the switch position-fixing member. This spacer is fixed, together with the switch position-fixing member, to an upper surface of the switch receiving portion by screws. The switches, fixed to the switch position-fixing member, are set to such a height that a head or part of each switch projects beyond an upper surface of the spacer. The upper surface sheet member provides a pounding surface which the player pounds with the palm, and this upper surface sheet member has a round shape, and is made of a resin material. When the upper surface sheet member is pounded, the head of the relevant switch, projecting from the upper surface of the spacer, is retracted, so that this switch outputs an ON-signal.

Boundary lines are indicated on the surface of the upper surface sheet member to divide this surface into three areas which can be confirmed with the eyes. The three areas are so determined that each area includes a plurality of switches. The plurality of switches within each area are connected in parallel with one another, and are combined into one signal conductor at their output end side. With this arrangement, whether any one of the switches within each area is turned on or two or more switches are simultaneously turned on, one switch operating signal is outputted from the output end (see, for example, JP-A-2002-239233 (Pages 4 to 5, FIG. 2)).

In the operating portion of the game controller disclosed in (JP-A-2002-239233 (Pages 4 to 5, FIG. 2)), the spacer is fixed to the upper surface of the switch receiving portion, and when a pounding operation is applied to the upper surface sheet member, the head of the switch, projecting from the upper surface of the spacer, is retracted, so that this switch is turned on. Whether any one of the switches within each of the three areas is turned on or two or more switches are simultaneously turned on, one switch operating signal is outputted from one area.

With respect to the above conventional construction, in order that two or more of switches within one area can be more positively operated when a pounding operation is applied to an upper surface sheet member, it may be proposed to provide a construction in which a spacer is moved toward the switches upon application of a pounding operation to the upper surface sheet member, and two or more switches can be simultaneously driven by switch drive portions provided at the spacer. In the case of this construction, for example, bosses are formed in a projected manner on the movable spacer, and guide holes for respectively guiding the sliding movements of the bosses are formed in a switch position-fixing member (fixed member). By thus providing such guide means between the spacer and the fixed member, the spacer can be smoothly moved toward the switches in accordance with a pounding operation on the upper surface sheet member.

Generally, the spacer, the switch position-fixing member, etc., (which are the constituent members of the operating portion) are molded of a resin. Usually, a high wear-resistant resin such as nylon is used to form the guide holes each for guiding the sliding movement of the corresponding boss each time a pounding operation is applied to the upper surface sheet member. However, nylon or the like (high wear-resistant resin) is higher in shrinkage and water absorption percentage during a molding operation as compared with a resin of high mechanical strength. Therefore, when the spacer is molded of the high mechanical-strength resin while the switch position-fixing member (having the guide holes formed therein) and so on are molded entirely of nylon or the like (high wear-resistant resin), large dimensional variations develop in the switch position-fixing member and so on, so that positional accuracies of the switch fixing holes and so on are degraded. As a result, it is difficult to output switch operating signals with good operability.

SUMMARY OF THE INVENTION

Therefore, there arises a technical problem which is to be solved in order to form switch-mounting portions, switch drive portions and so on, provided at a top hoop and a spacer, with high positional precision so that switch operating signals can be outputted with positive and good operability. An object of the present invention is solve this problem.

The present invention has been proposed in order to achieve the above object, and according to the invention there is provided a controller operating portion structure characterized in that the structure comprises a top hoop which is adapted to be mounted at one end of a housing resembling a barrel of a drum, and includes a flat plate portion having a switch-mounting portion at which a switch is mounted; a top rubber which is attached to an upper side of tire top hoop, and provides a pounding surface used for a pounding operation; and a spacer which is provided between the top rubber and the top hoop, and has a switch drive portion for driving the switch in accordance with a pounding operation on the top rubber; and a boss is formed on and projects from the spacer; and a guide hole for guiding the movement of the boss in accordance with a pounding operation on the top rubber is formed in the flat plate portion of the top hoop; and a bushing, made of a high wear-resistant resin, is mounted in the guide hole.

In this construction, generally, the top hoop and the spacer are molded of the resin of high mechanical strength. The high wear-resistant resin, in which problems concerning shrinkage percentage and others arise in a molding operation, is used only to form the busing as a separate part. By doing so, the top hoop and the spacer can be produced without inviting the shrinkage percentage problem and others in the molding operation, so that the switch-mounting portion, the switch drive portion and so on can be formed with high positional accuracy. As a result, a switch operating signal can be outputted with positive and good operability.

The invention provides the controller operating portion structure, characterized in that the high wear-resistant resin is nylon.

In this construction, it is difficult to mold nylon (which is a high wear-resistant resin) with high dimensional accuracy as compared with a resin of high mechanical strength. This high wear-resistant resin is used only to form the bushing as a separate part, and by doing so, the top hoop and the spacer can be produced in such a manner that the switch-mounting portion, the switch drive portion and so on are formed with high positional accuracy. And besides, since the bushing is made of nylon having good sliding properties and wear resistance, a switch operating signal can be outputted with better operability.

The invention provides the controller operating portion structure, characterized in that the bushing has retaining means for retaining the bushing relative to guide hole, and is designed to be detachably mounted in the guide hole.

In this construction, when the bushing is damaged or worn, it can be easily exchanged with a new one.

The invention of provides the controller operating portion structure, characterized in that the bushing, made of the high wear-resistant resin, is molded integrally with the top hoop made of a resin having high mechanical strength.

In this construction, the bushing and the top hoop are molded into an integral construction, and therefore the structure can be easily assembled. Even in this construction, by using nylon (high wear-resistant resin) only to form the bushing, the top hoop and the spacer can be produced in such a manner that the switch-mounting portion, the switch drive portion and so on can be formed with high positional accuracy.

The invention provides the controller operating portion structure, characterized in that there are provided a plurality of guide means each comprising a combination of the boss and the guide hole in which the busing is mounted.

In this construction, the spacer is prevented by the plurality of guide means from moving in a direction perpendicular to the direction of application of a pounding operation on the top rubber. As a result, a switch operating signal can be outputted with the more positive and better operability.

The invention provides a controller operating portion structure, characterized in that a boundary line is indicated on the pounding surface of the top rubber to divide the pounding surface into a plurality of areas, and the spacer is divided into a plurality of sections corresponding respectively to the plurality of areas, and a plurality of guide means are provided for each of the division areas.

In this construction, the spacer is divided into the sections, and a separate switch operating signal for each division area can be outputted, and even in this case, the spacer is prevented from moving in the direction perpendicular to the direction of application of a pounding operation on the top rubber. As a result, a separate switch operating signal for each area can be outputted with the positive and good operability.

In the invention, the boss is formed on and projects from the spacer, and the guide hole for guiding the movement of the boss in accordance with a pounding operation on the top rubber is formed in the flat plate portion of the top hoop, and the bushing, made of the high wear-resistant resin, is mounted in the guide hole. Therefore, the switch-mounting portion, the switch drive portion and so on, provided at the top hoop and the spacer, can be formed with high positional accuracy, and a switch operating signal can be outputted with positive and good operability.

In the invention, the high wear-resistant resin is nylon. Therefore, the advantage of the invention is achieved, and besides since the bushing is made of nylon having high wear-resistance and good sliding properties, there is achieved an advantage that a switch operating signal can be outputted with better operability.

In the invention, the bushing has the retaining means for retaining the bushing relative to the guide hole, and is designed to be detachably mounted in the guide hole. Therefore, in addition to the advantage of the invention, there is achieved an advantage that when the bushing is damaged or worm, it can be easily exchanged with a new one.

In the invention, the bushing, made of the high wear-resistant resin, is molded integrally with the top hoop made of the resin having high mechanical strength. Therefore, in addition to the advantage of the invention, there is achieved an advantage that the easily-assembling construction can be obtained because of integral molding of the bushing on the top hoop.

In the invention, there are provided the plurality of guide means each comprising a combination of the boss and the guide hole in which the busing is mounted. Therefore, in addition to the advantage of the invention, there is achieved an advantage that the spacer is prevented by the plurality of guide means from moving in the direction perpendicular to the direction of application of a pounding operation on the top rubber, so that a switch operating signal can be outputted with the more positive and better operability.

In the invention, the boundary line is indicated on the pounding surface of the top rubber to divide the pounding surface into the plurality of areas, and the spacer is divided into the plurality of sections corresponding respectively to the plurality of areas, and the plurality of the guide means are provided for each of the division areas. Therefore, the advantage of the invention is achieved, and even in the case where the spacer is divided into the sections, and a separate switch operating signal for each division area can be outputted, the spacer is prevented from moving in the direction perpendicular to the direction of application of a pounding operation on the top rubber, thereby achieving an advantage that a separate switch operating signal for each area can be outputted with the positive and good operability.

BRIEF DESCRIPTION OF THE DRAWINGS

The drawings illustrate a preferred embodiment of the present invention.

DESCRIPTION OF THE PREFERRED EMBODIMENTS

The object to form switch-mounting portions, switch drive portions and so on, provided at a top hoop and a spacer, with high positional precision so that switch operating signals can be outputted with positive and good operability has been achieved by a construction in which bosses are formed on and project from the spacer made of an ABS resin (high mechanical-strength resin), and guide holes each for guiding the movement of the corresponding boss in accordance with a pounding operation on a top rubber are formed in a flat plate portion of the top hoop made of an ABS resin (high mechanical-strength resin), and bushings, made of nylon (high wear-resistant resin), are mounted respectively in the guide holes.

(First Embodiment)

Figure 1:
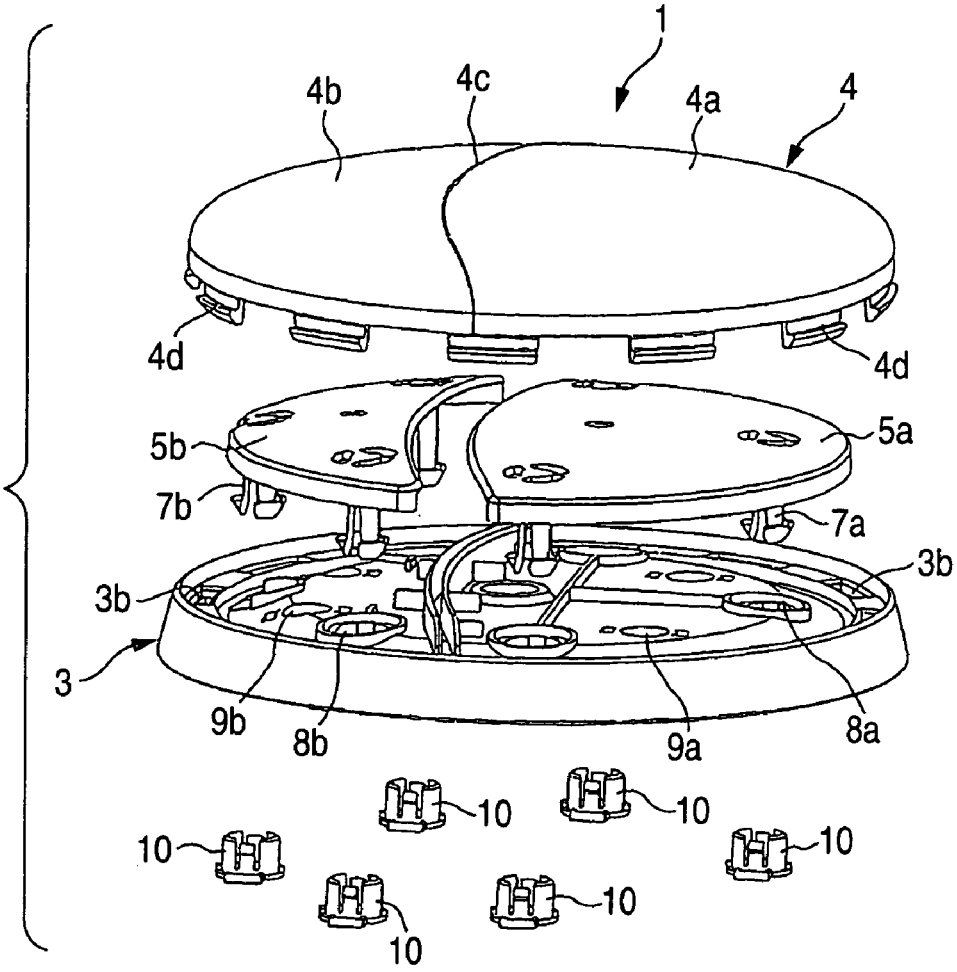
FIG. 1 is an exploded perspective view of a controller operating portion structure.
Figure 2:
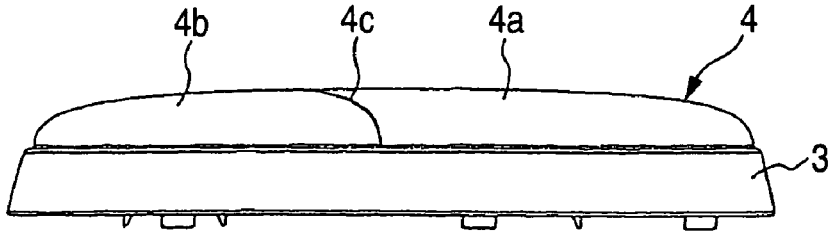
FIG. 2 is a side-elevational view of the controller operating portion structure.
Figure 3:
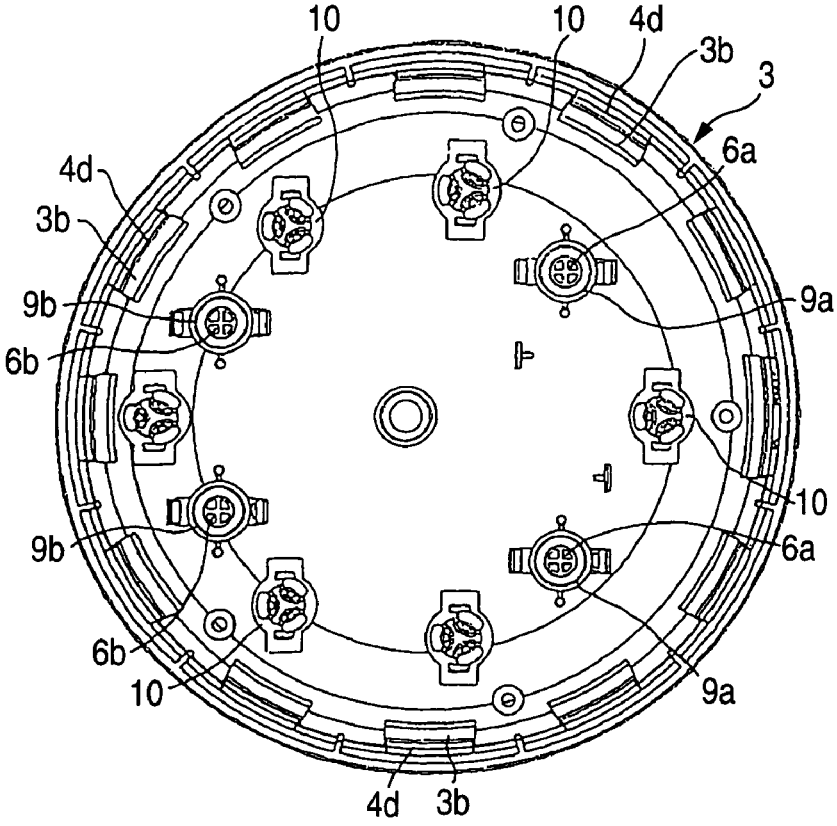
FIG. 3 is a bottom view of the controller operating portion structure, with the mounting of switches omitted.
Figure 4:
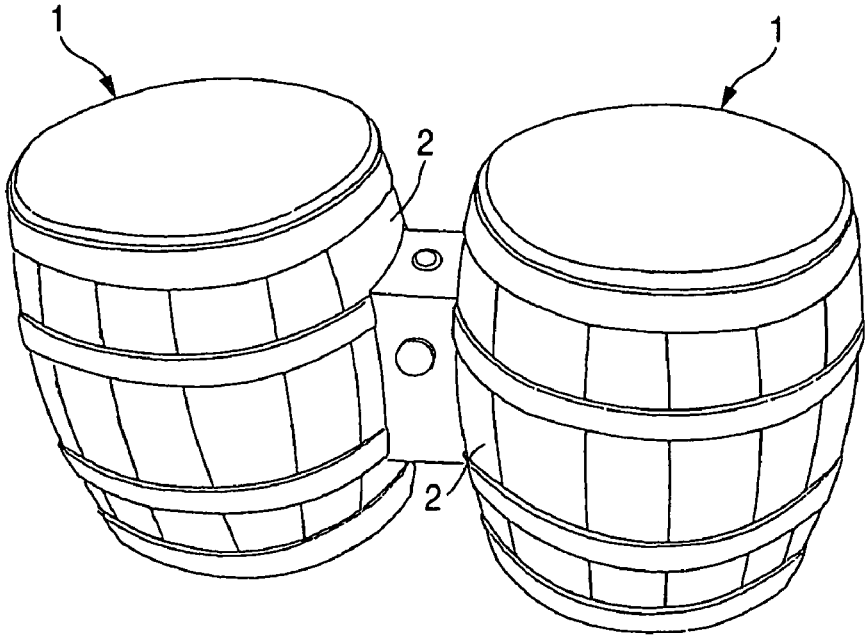
FIG. 4 is a perspective view showing the appearance of the controller operating portion structures mounted respectively at one ends of barrel housings.
Figure 5:
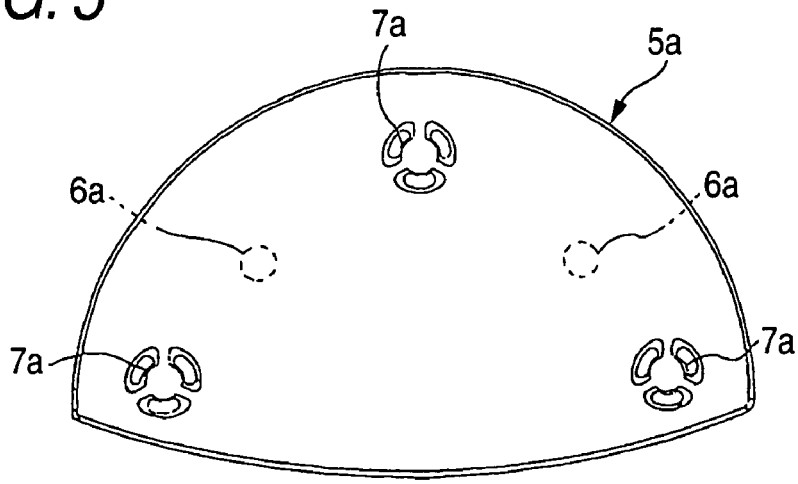
FIG. 5 is a plan view of an A spacer of the division type.
Figure 6:
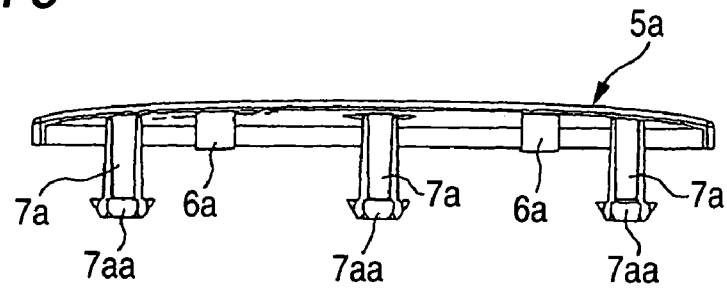
FIG. 6 is a front-elevational view of the spacer of FIG. 5.
Figure 7:
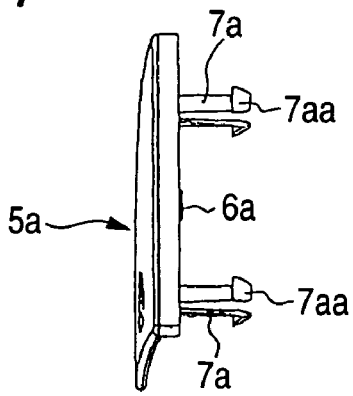
FIG. 7 is a side-elevational view of the spacer of FIG. 5.
Figure 8:
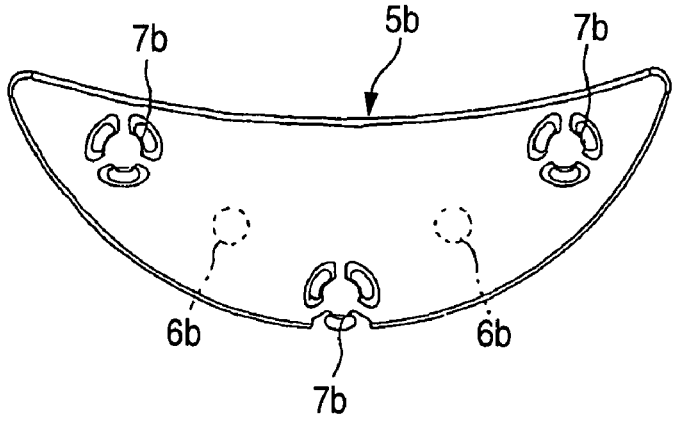
FIG. 8 is a plan view of a B spacer of the division type.
Figure 9:
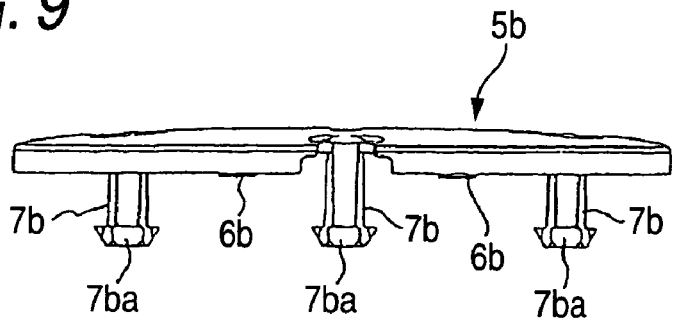
FIG. 9 is a front-elevational view of the spacer of FIG. 8.
Figure 10:
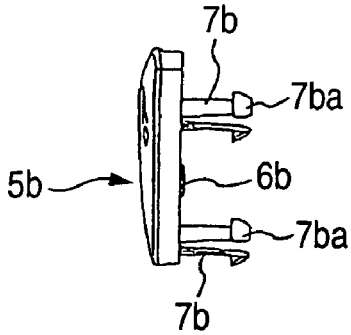
FIG. 10 is a side-elevational view of the spacer of FIG. 8.
Figure 12:
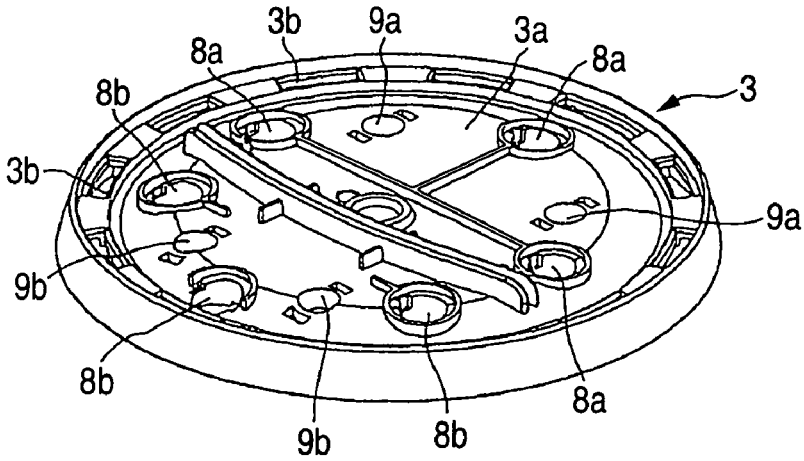
FIG. 12 is a perspective view of the top hoop.
Figure 13:
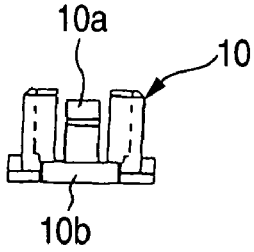
FIG. 13 is a front-elevational view of a bushing.
Figure 14:
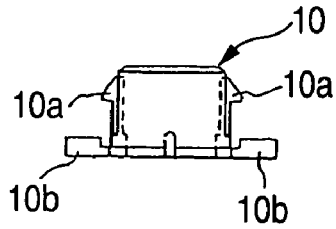
FIG. 14 is a side-elevational view of the bushing of FIG. 13.
Figure 15:
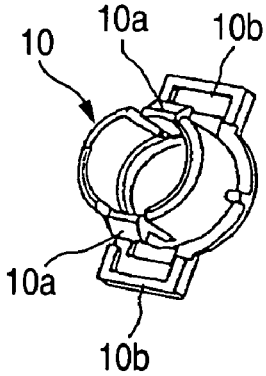
FIG. 15 is a perspective view of the bushing.
Figure 16:
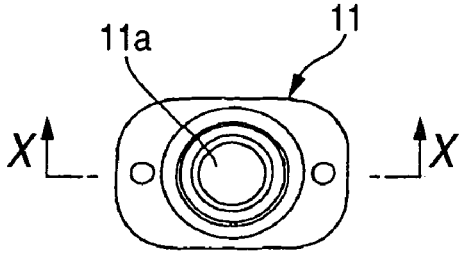
FIG. 16 is a plan view of a switch.
Figure 17:
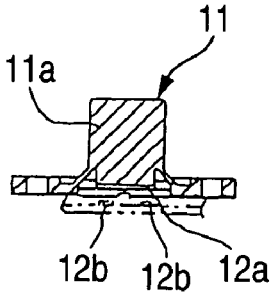
FIG. 17 is a cross-sectional view taken along the line X—X of FIG.

A first embodiment of the present invention will now be described in detail with reference to the drawings. FIGS. 1 to 3 are an exploded perspective view, a side-elevational view and a bottom view of a controller operating portion structure, respectively, FIG. 4 is a perspective view showing the appearance of the controller operating portion structures mounted respectively at one ends of barrel housings, FIGS. 5 to 7 are a plan view, a front-elevational view and a side-elevational view of an A spacer of the division type, respectively, FIGS. 8 to 10 are a plan view, a front-elevational view and a side-elevational view of a B spacer of the division type, respectively, FIGS. 10 and 12 are a plan view and a perspective view of a top hoop, respectively, FIGS. 13 to 15 are a front-elevational view, a side-elevational view and a perspective view of a bushing, respectively, and FIGS. 16 and 17 are a plan view and a cross-sectional view of a switch, respectively. First, the construction of the controller operating portion structure of this embodiment will be described. As shown in FIG. 4, the controller operating portion structures 1 are mounted respectively at one ends (upper ends) of the two juxtaposed housings 2 and 2 each resembling a barrel portion of a drum. As shown in FIGS. 1 to 3, the controller operating portion structure 1 comprises the top hoop 3, a top rubber 4 attached to the upper side of the top hoop 3 to provide a pounding surface used for a pounding operation, and the spacers 5*a* and 5*b* which are provided between the top rubber 4 and the top hoop 3, and can be moved toward the top hoop 3 in accordance with an pounding operation on the top rubber 4.

The construction of each of the above members will be described. As shown in FIG. 1, the top rubber 4 is formed into a round crown-like configuration of a small height, using synthetic rubber which is an elastomer exhibiting marked elasticity at around ordinary temperature. The pounding surface of this top rubber 4 is divided into two areas, that is, an A area 4*a* and a B area 4*b*, by a boundary line 4*c* indicated on the upper surface thereof. A number of retaining portions 4*d*, each having a hook-like vertical cross-section, are formed on and project downwardly (FIG. 1) from an outer peripheral portion of the small-height round crown-like body Thanks to the provision of the plurality of retaining portions 4*d*, the top rubber 4 can be attached to and detached from the top hoop 3. Here, the pounding surface of the top rubber 4 is divided into the A area 4*a* and the B area 4*b* as described above, and therefore the top rubber 4 need to be attached to the top hoop 3 in predetermined opposed relation thereto. In order to specify this predetermined opposed condition, a predetermined one of the plurality of retaining portions 4*d* is larger in size than the others.

As shown in FIG. 1, the spacer, having a disk-like configuration of a medium height, is formed, using an ABS (Acrylonitrile-Butadiene-Styrene) resin having a high mechanical strength, and this spacer is divided into the A-area spacer (referred to as "A spacer") 5*a* and the B-area spacer (referred to as "B spacer") in corresponding relation to the two division areas of the top rubber 4. As shown in FIGS. 5 to 7, two switch drive portions 6*a* and 6*a* for respectively driving switches (described later) in accordance with a pounding operation on the top rubber 4 are generally bilaterally symmetrically (FIG. 5) formed on and project from a lower surface of the A spacer 5*a*. Also, three bosses 7*a* of a predetermined length are formed on and project from the lower surface of the A spacer 5*a*, and are disposed generally at apexes of an isosceles triangle, respectively. Each of the bosses 7*a* is divided into three boss sections each having elasticity, and a hook-like piece portion 7*aa* is formed at a lower end of each of the boss sections. In a generally similar arrangement to the above, two switch drive portions 6*b* and three bosses 7*b* are formed on and project from a lower surface of the B spacer 5*b* as shown in FIGS. 8 to 10, and hook-like piece portions 7*ba* are formed at a lower end of each of the bosses 7*b*.

Figure 11:
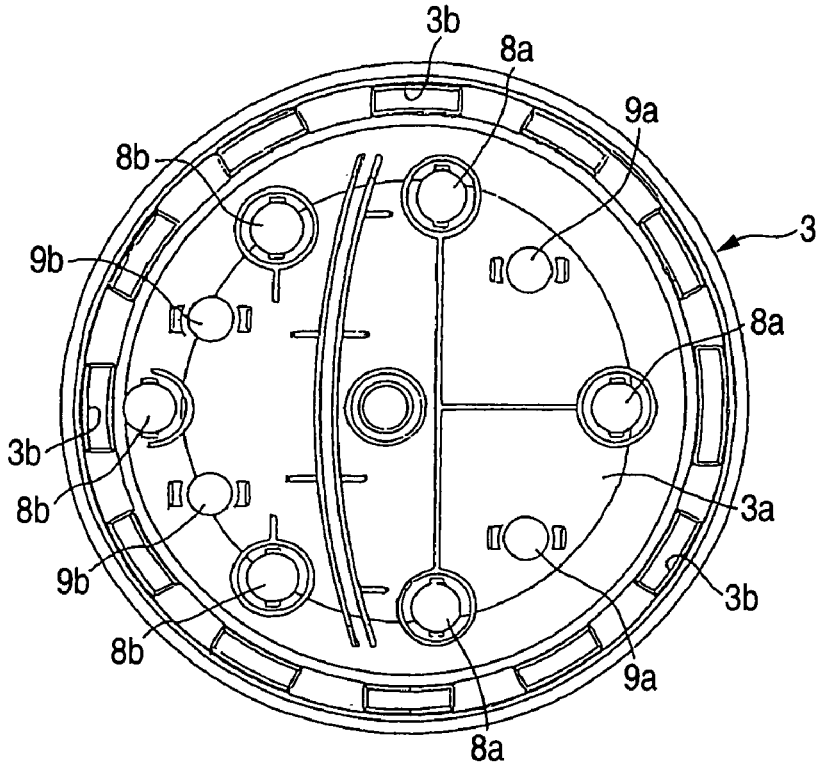
FIG. 11 is a plan view of a top hoop.

Using an ABS resin of a high mechanical strength, the top hoop 3 is formed into such a shape that a flat plate portion 3*a* is provided within an annular portion as shown in FIGS. 11 and 12. Three guide holes 8*a* for respectively guiding the movements of the bosses 7*a* of the A spacer 5*a* in accordance with a pounding operation on the A area 4*a* of the top rubber 4, as well as two switch-mounting portions 9*a* and 9*a* (in which the switches (which can be driven respectively by the switch drive portions 6*a* and 6*a* of the A spacer 5*a*) are mounted, respectively) are formed at that portion of the flat plate portion 3*a* corresponding to the A area 4*a* of the top rubber 4. Similarly, three guide holes 8*b* for respectively guiding the movements of the bosses 7*b* of the B spacer 5*b*, as well as two switch-mounting portions 9*b* and 9*b* (in which the switches (which can be driven respectively by the switch drive portions 6*b* and 6*b* of the B spacer 5*b*) are mounted, respectively) are formed at that portion of the flat plate portion 3*a* corresponding to the B area 4*b* of the top rubber 4. A number of retaining hole 3*b* are formed in an outer peripheral portion of the top hoop 3, and the plurality of retaining portions 4*d*, formed on the top rubber 4, can be retainingly engaged respectively in these retaining holes 3*b*. A predetermined one of the plurality of retaining holes 3*b*, corresponding to the predetermined retaining portion 4*d*, is larger in size of opening than the others.

FIGS. 13 to 15 show the bushing 10, and the bushings 10 are adapted to be mounted respectively in the guide holes 8*a* and 8*b* formed in the flat plate portion 3*a* of the top hoop 3.

The bushing 10 is formed into a generally cylindrical shape, using nylon (which is a resin having good sliding properties and high wear resistance). Elastic hook-like retaining portions 10*a* are formed respectively at diametrically-opposite portions of the cylindrical body (main body), and extension portions 10*b* are formed on and extend radially outwardly from a bottom portion (in the drawings) of the cylindrical body. The retaining portions 10*a* and the extension portions 10*b* form retaining means for retaining the bushing relative to the guide hole 8*a*, 8*b*. Thanks to the provision of this retaining means, the bushing 10 can be detachably mounted in the guide hole 8*a*, 8*b*. For mounting the bushing 10 in the guide hole 8*a*, 8*b*, the bushing 10 is inserted into the guide hole 8*a*, 8*b* from the lower side of the top hoop 3 as shown in FIG. 1, while elastically deforming the retaining portions 10*a* inwardly toward each other. When the bushing is inserted in a predetermined amount, the elastically-deformed retaining portions 10*a* are restored into their original condition, and as a result the retaining portions 10 are retainingly engaged with an upper edge portion of the guide hole 8*a*, 8*b* while the extension portions 10*b* are retainingly engaged with a lower edge portion of the guide hole 8*a*, 8*b*, thereby fixing the bushing 10 to the guide hole 8*a*, 8*b*.

FIGS. 16 and 17 show the rubber switch 11, and the rubber switches 11 are adapted to be mounted respectively in the switch-mounting portions 9*a* and 9*b* formed in the flat plate portion 3*a* of the top hoop 3. The rubber switch 11 comprises a main body 11*a* including a cylindrical portion made of silicone rubber, a moving contact 12*a* which is made of electrically-conductive rubber, and is fixedly secured to a lower surface of the cylindrical portion, and two fixed contacts 12*b* provided in opposed relation to the moving contact 12*a*. The cylindrical portion of the main body 11*a* of each rubber switch 11 is fitted in the corresponding switch-mounting portion 9*a*, 9*b*, and is fixed thereto. When an upper surface of the cylindrical portion of the main portion 11*a* of each rubber switch 11 is pressed by the corresponding switch drive portion 6*a*, 6*b*, the rubber switch 11 is driven to output an ON-operating signal.

The controller operating portion structure 1 is formed by assembling the members of the above constructions together. The bosses 7*a* of the A spacer 5*a* are fitted respectively in the bushings 10 mounted respectively in the guide holes 8*a* in the top hoop 3, and also springs (not shown) are provided in a contracted condition between the lower surface of the A spacer 5*a* and the flat plate portion 3*a* of the top hoop 3. As a result, thanks to resilient forces of the springs and also to the retaining engagement of the hook-like piece portions 7*aa* of the bosses 7*a* with the lower edge portions of the respective guide holes 8*a*, the A spacer 5*a* is resiliently mounted on the top hoop 3 in such a manner that the A spacer 5*a* is kept spaced a predetermined distance from the flat plate portion 3*a*. Similarly, The bosses 7*b* of the B spacer 5*b* are fitted respectively in the bushings 10 mounted respectively in the guide holes 8*b* in the top hoop 3, and also springs (not shown) are provided in a contracted condition between the lower surface of the B spacer 5*b* and the flat plate portion 3*a* of the top hoop 3. As a result, thanks to resilient forces of the springs and also to the retaining engagement of the hook-like piece portions 7*ba* of the bosses 7*b* with the lower edge portions of the respective guide holes 8*b*, the B spacer 5*b* is resiliently mounted on the top hoop 3 in such a manner that the B spacer 5*b* is kept spaced a predetermined distance from the flat plate portion 3*a*.

After the A spacer 5*a* and the B spacer 5*b* are mounted on the top hoop 3, the retaining portions 4*d* of the top rubber 4 are fitted respectively into the retaining holes 3*b* in the top hoop 3, and are retained thereto. As a result, the top rubber 4 is attached to the top hoop 3 in the predetermined opposed condition relative thereto, and also covers the A spacer 5*a* and the B spacer 5*b*, so that the controller operating portion structure 1 is assembled. In this assembled construction, three guide means, each comprising a combination of the boss 7*a* and the guide hole 8*a* receiving the bushing 10, are provided for the A area 4*a*, while three guide means, each comprising a combination of the boss 7*b* and the guide hole 8*b* receiving the bushing 10, are provided for the B area 4*b*.

Next, the operation of the controller operating portion structure of the above construction will be described. The top hoop 3 and the two spacers (A and B spacers) 5*a* and 5*b* are molded of an ABS resin having high mechanical strength, while nylon (which is a high wear-resistant resin and in which a shrinkage percentage problem and others are encountered during a molding operation) is used only to form the bushings 10 as separate parts. By doing so, the top hoop 3 and the two spacers (A and B spacers) 5*a* and 5*b* can be produced without inviting a shrinkage percentage problem and others in such a manner that the switch-mounting portions 9*a* and 9*b*, the switch drive portions 6*a* and 6*b* and so on can be formed with high positional accuracy. And besides, the bushing 10 made of nylon is mounted in each guide hole 8*a*, 8*b*, and therefore a good sliding performance can be obtained. Furthermore, the three guide means are provided for each of the A area 4*a* and the B area 4*b*, and therefore each of the spacers 5*a* and 5*b* is prevented from moving in a direction perpendicular to the direction of application of a pounding operation on the top rubber 4. As a result, switch operating signals can be outputted with the positive and good operability When a pounding operation is applied to the A area 4*a* of the top rubber 4, the A spacer 5*a*, while guided by the three guide means (each comprising the combination of the boss 7*a* and the guide hole 8*a* receiving the bushing 10), is moved toward the top hoop 3, and at least one of the two rubber switches 11 and 11, mounted respectively in the switch-mounting portions 9*a* and 9*a* in the top hoop 3, is turned on by the corresponding switch drive portion 6*a* of the A spacer 5*a* to output an ON-operating signal relating to the A area 4*a*. Also, when a pounding operation is applied to the B area 4*b* of the top rubber 4, the B spacer 5*b*, while guided by the three guide means (each comprising the combination of the boss 7*b* and the guide hole 8*b* receiving the bushing 10), is moved toward the top hoop 3, and at least one of the two rubber switches 11 and 11, mounted respectively in the switch-mounting portions 9*b* and 9*b* in the top hoop 3, is turned on by the corresponding switch drive portion 6*b* of the B spacer 5*b* to output an ON-operating signal relating to the B area 4*b*.

As described above, in the controller operating portion structure of this embodiment, the switch-mounting portions 9*a* and 9*b*, the switch drive portions 6*a* and 6*b* and so on, provided at the top hoop 3 and the two spacers (A and B spacers) 5*a* and 5*b*, can be formed with high positional precision, and switch operating signals can be outputted with positive and good operability. And besides, the bushings 10 can be detachably mounted in the guide holes 8*a* and 8*b*, respectively, and therefore when any of these bushings 10 is damaged or worn, it can be easily exchanged with a new one.

(Second Embodiment)

In this embodiment, the bushings 10, made of nylon (high wear-resistant resin), and the top hoop 3, made of an ABS resin (having high mechanical strength), are molded into an integral construction by so-called two-color molding.

In this embodiment, the bushings 10 are molded integrally with the top hoop 3, and by doing so, the management of the parts is easy, ad besides the controller operating portion structure can be easily assembled. Even in this easily-assembling construction, by using nylon (high wear-resistant resin) only to form the bushings 10, the top hoop 3 and the two spacers (A and B spacers) 5*a* and 5*b* can be produced in such a manner that the switch-mounting portions 9*a* and 9*b*, the switch drive portions 6*a* and 6*b* and so on can be formed with high positional accuracy.

In the present invention, various modifications can be made without departing from the spirits of the invention, and such modifications will naturally fall within the scope of the invention.

What is claimed is:

1. A switch structure for a game controller, comprising:

a supporting member, formed with a hole extending in a first direction;

at least one switch, provided on the supporting member;

a tubular bushing, fitted into the hole; and a cover, attached to the supporting member so as to be movable in the first direction, the cover comprising:

at least one actuator, operable to actuate the switch in accordance with the movement of the cover; and a boss, inserted into the hole attached with the bushing so as to be movable in the first direction;

wherein the supporting member is comprised of a first resin material having a first hardness and a first wear-resistance; and the bushing is comprised of a second resin material having a second hardness which is lower than the first hardness and a second wear-resistance which is higher than the first wear-resistance.

2. The switch structure for a game controller according to claim 1, wherein the second resin material is comprised of nylon.

3. The switch structure for a game controller according to claim 1, wherein:

the bushing comprises a retainer retaining the bushing in the hole, and the bushing is configured to be detachably fitted.

4. The switch structure for a game controller according to claim 1, wherein the bushing is monolithically formed with the hole.

5. The switch structure for a game controller according to claim 1, wherein the boss and the hole serve to guide the movement of the cover.

6. The switch structure for a game controller according to claim 1, wherein:

the cover is divided into a plurality of areas;

a plurality of switches are mounted on the supporting member and the cover is provided with a plurality of actuators; and each of the areas has at least one of the actuators to actuate at least one of the switches.

* * * * *